US010499128B2

(12) United States Patent
Zaba et al.

(10) Patent No.: US 10,499,128 B2
(45) Date of Patent: Dec. 3, 2019

(54) PLAYBACK DEVICES HAVING WAVEGUIDES WITH DRAINAGE FEATURES

(71) Applicant: Sonos, Inc, Santa Barbara, CA (US)

(72) Inventors: Camille Zaba, Santa Barbara, CA (US); Michael Chamness, Glouchester, MA (US); Greg Flanagan, Santa Barbara, CA (US); Garrett Gardner, Santa Barbara, CA (US); Brandon Holley, Santa Barbara, CA (US)

(73) Assignee: Sonos, Inc., Santa Barbara, CA (US)

( * ) Notice: Subject to any disclaimer, the term of this patent is extended or adjusted under 35 U.S.C. 154(b) by 0 days.

(21) Appl. No.: 15/958,815

(22) Filed: Apr. 20, 2018

(65) Prior Publication Data

US 2019/0327547 A1 Oct. 24, 2019

(51) Int. Cl.

| | |
|---|---|
| ***H04R 1/00*** | (2006.01) |
| ***H04R 1/02*** | (2006.01) |
| ***H04R 31/00*** | (2006.01) |
| ***H04R 1/28*** | (2006.01) |

(52) U.S. Cl.
CPC ..... *H04R 1/025* (2013.01); *H04R 1/2857* (2013.01); *H04R 31/006* (2013.01)

(58) Field of Classification Search
CPC ..... H04R 1/345; H04R 1/2853; H04R 1/2857
See application file for complete search history.

(56) References Cited

U.S. PATENT DOCUMENTS

| | | | | |
|---|---|---|---|---|
| 2,210,477 | A * | 8/1940 | Bialk | H04R 1/345 181/150 |
| 5,440,644 | A | 8/1995 | Farinelli et al. | |
| 5,761,320 | A | 6/1998 | Farinelli et al. | |
| 5,923,902 | A | 7/1999 | Inagaki | |
| 6,032,202 | A | 2/2000 | Lea et al. | |
| 6,256,554 | B1 | 7/2001 | Dilorenzo | |
| 6,404,811 | B1 | 6/2002 | Cvetko et al. | |
| 6,469,633 | B1 | 10/2002 | Wachter | |
| 6,522,886 | B1 | 2/2003 | Youngs et al. | |
| 6,611,537 | B1 | 8/2003 | Edens et al. | |
| 6,631,410 | B1 | 10/2003 | Kowalski et al. | |
| 6,757,517 | B2 | 6/2004 | Chang | |
| 6,778,869 | B2 | 8/2004 | Champion | |
| 7,130,608 | B2 | 10/2006 | Hollstrom et al. | |
| 7,130,616 | B2 | 10/2006 | Janik | |
| 7,143,939 | B2 | 12/2006 | Henzerling | |

(Continued)

FOREIGN PATENT DOCUMENTS

| | | |
|---|---|---|
| EP | 1389853 A1 | 2/2004 |
| WO | 200153994 | 7/2001 |
| WO | 2003093950 A2 | 11/2003 |

OTHER PUBLICATIONS

AudioTron Quick Start Guide, Version 1.0, Mar. 2001, 24 pages.

(Continued)

*Primary Examiner* — Matthew A Eason
(74) *Attorney, Agent, or Firm* — McDonnell Boehnen Hulbert & Berghoff LLP

(57) ABSTRACT

A playback device comprises an acoustic waveguide having a bounding surface, the bounding surface delimiting an opening. A drainage channel extends from the opening and is arranged to direct liquid from inside the waveguide toward a drainage outlet.

19 Claims, 7 Drawing Sheets

(56) References Cited

U.S. PATENT DOCUMENTS

| | | | |
|---|---|---|---|
| 7,236,773 | B2 | 6/2007 | Thomas |
| 7,295,548 | B2 | 11/2007 | Blank et al. |
| 7,391,791 | B2 | 6/2008 | Balassanian et al. |
| 7,483,538 | B2 | 1/2009 | McCarty et al. |
| 7,571,014 | B1 | 8/2009 | Lambourne et al. |
| 7,630,501 | B2 | 12/2009 | Blank et al. |
| 7,643,894 | B2 | 1/2010 | Braithwaite et al. |
| 7,657,910 | B1 | 2/2010 | McAulay et al. |
| 7,853,341 | B2 | 12/2010 | McCarty et al. |
| 7,987,294 | B2 | 7/2011 | Bryce et al. |
| 8,014,423 | B2 | 9/2011 | Thaler et al. |
| 8,045,952 | B2 | 10/2011 | Qureshey et al. |
| 8,103,009 | B2 | 1/2012 | McCarty et al. |
| 8,234,395 | B2 | 7/2012 | Millington et al. |
| 8,483,853 | B1 | 7/2013 | Lambourne |
| 8,942,252 | B2 | 1/2015 | Balassanian et al. |
| 2001/0042107 | A1 | 11/2001 | Palm |
| 2002/0022453 | A1 | 2/2002 | Balog et al. |
| 2002/0026442 | A1 | 2/2002 | Lipscomb et al. |
| 2002/0124097 | A1 | 9/2002 | Isely et al. |
| 2003/0157951 | A1 | 8/2003 | Hasty |
| 2004/0024478 | A1 | 2/2004 | Hans et al. |
| 2007/0142944 | A1 | 6/2007 | Goldberg et al. |

OTHER PUBLICATIONS

AudioTron Reference Manual, Version 3.0, May 2002, 70 pages.
AudioTron Setup Guide, Version 3.0, May 2002, 38 pages.
Bluetooth. "Specification of the Bluetooth System: The ad hoc SCATTERNET for affordable and highly functional wireless connectivity," Core, Version 1.0 A, Jul. 26, 1999, 1068 pages.
Bluetooth. "Specification of the Bluetooth System: Wireless connections made easy," Core, Version 1.0 B, Dec. 1, 1999, 1076 pages.
Dell, Inc. "Dell Digital Audio Receiver: Reference Guide," Jun. 2000, 70 pages.
Dell, Inc. "Start Here," Jun. 2000, 2 pages.
"Denon 2003-2004 Product Catalog," Denon, 2003-2004, 44 pages.
Jo et al., "Synchronized One-to-many Media Streaming with Adaptive Playout Control," Proceedings of SPIE, 2002, pp. 71-82, vol. 4861.
Jones, Stephen, "Dell Digital Audio Receiver: Digital upgrade for your analog stereo," Analog Stereo, Jun. 24, 2000 retrieved Jun. 18, 2014, 2 pages.
Louderback, Jim, "Affordable Audio Receiver Furnishes Homes With MP3," TechTV Vault. Jun. 28, 2000 retrieved Jul. 10, 2014, 2 pages.
Palm, Inc., "Handbook for the Palm VII Handheld," May 2000, 311 pages.
Presentations at WinHEC 2000, May 2000, 138 pages.
United States Patent and Trademark Office, U.S. Appl. No. 60/490,768, filed Jul. 28, 2003, entitled "Method for synchronizing audio playback between multiple networked devices," 13 pages.
United States Patent and Trademark Office, U.S. Appl. No. 60/825,407, filed Sep. 12, 2006, entitled "Controlling and manipulating groupings in a multi-zone music or media system," 82 pages.
UPnP; "Universal Plug and Play Device Architecture," Jun. 8, 2000; version 1.0; Microsoft Corporation; pp. 1-54.
Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.

* cited by examiner

PLAYBACK DEVICES HAVING WAVEGUIDES WITH DRAINAGE FEATURES

TECHNICAL FIELD

The disclosed technology generally relates to audio playback devices configured for use in environments where they may come into contact with water or other liquids.

BACKGROUND

Options for accessing and listening to digital audio in an out-loud setting were limited until in 2003, when SONOS, Inc. filed for one of its first patent applications, entitled "Method for Synchronizing Audio Playback between Multiple Networked Devices," and began offering a media playback system for sale in 2005. The Sonos Wireless HiFi System enables people to experience music from many sources via one or more networked playback devices. Through a software control application installed on a smartphone, tablet, or computer, one can play audio in any room that has a networked playback device. Additionally, using the control device, for example, different songs can be streamed to each room with a playback device, rooms can be grouped together for synchronous playback, or the same song can be heard in all rooms synchronously.

Given the ever growing interest in digital media, there continues to be a need to develop consumer-accessible technologies to further enhance the listening experience.

DETAILED DESCRIPTION

Figure 1:
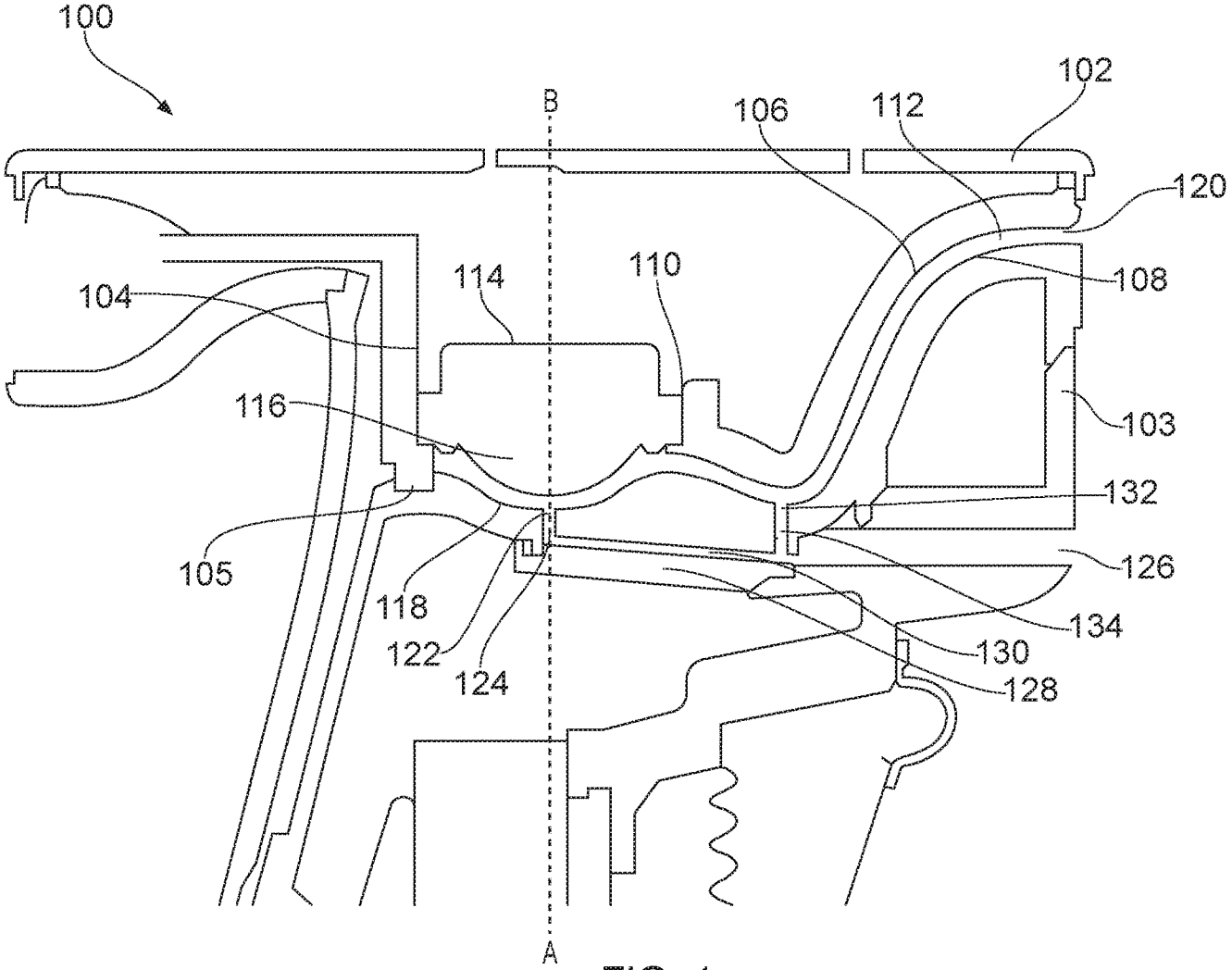
FIG. 1 is a cross-sectional side view in an axial plane of a playback device configured in accordance with embodiments of the disclosed technology.

A conventional tweeter system in an audio playback device includes a diaphragm that is displaced in response to an alternating electrical signal, thereby generating high-frequency acoustic waves (for example, acoustic waves having a frequency of between about 2 kilohertz (kHz) and about 20 kHz). The diaphragm in many cases is shaped as a cupola, and may be surrounded by an acoustic lens that diffracts the generated acoustic waves. A cupola-shaped diaphragm and an acoustic lens can be used to achieve angular dispersion of the waves as they are emitted from the tweeter system. However, due to the relatively short wavelengths of the emitted waves in comparison with the aperture of the acoustic lens, the angular dispersion of the emitted waves is limited to a relatively narrow angle. An angular dispersion of around 10 degrees from normal can be typical for waves having frequencies in the middle of the tweeter's operating range (e.g., between about 6 kHz and about 10 kHz).

Angular dispersion is particularly desirable for playback devices designed to be used in non-reverberant environments, such as outdoor environments. In typical outdoor scenarios, a playback device is not surrounded by walls, and therefore angular dispersion is necessary to ensure listeners at different angles around the playback device are able to hear audio generated by the playback device. It is desirable for users located at different angles around the playback device to have similar listening experiences.

Angular dispersion of high-frequency acoustic waves generated by a playback device may be improved by placing an electroacoustic transducer in fluid communication with an acoustic waveguide. In some examples, an opening of an acoustic waveguide subtends a wide angle in a plane (for example, a horizontal plane), resulting in wide angular dispersion in the plane. In some examples, an opening of an acoustic waveguide has a small dimension in a direction of an axis (for example, a vertical axis), resulting in a wide angular dispersion in planes coplanar with the axis.

A playback device designed for use in an outdoor environment is likely to be exposed to water or other liquids, for example due to precipitation, splashing in a poolside environment or other water sources such as hoses and sprinkler systems. Any opening in an outer housing of such a device, for example an opening of a waveguide, may be vulnerable to the water or other liquid entering the device. Water or other liquids inside a playback device may have detrimental effects. For example, if water enters an opening of a waveguide, the water may have detrimental acoustic effects on acoustic waves emitted from the waveguide. Furthermore, if water or another liquid enters a playback device, it may cause corrosion or other damage to internal components of the playback device. It is desirable for a playback device designed for outdoor use to have a high level of water resistance. For example, the device can be compliant with International Protection code IPX4, which requires that water splashed against the device from any angle has no harmful effect on the device, or can be compliant with IPX5, which requires that water projected by a nozzle against the device from any direction has no harmful effect on the device. Playback devices can have useable lifetimes of several years or several tens of years, and therefore the effects of corrosion or damage may accumulate over similarly long periods of time, particularly if water or other liquids remain inside the device for a significant period of time.

FIG. 1 is a cross-sectional side view in an axial plane of a playback device configured in accordance with embodiments of the disclosed technology. The playback device 100 has an upper housing 102 and a lower housing 103. The upper housing 102 and the lower housing 103 are formed from a corrosion-resistant plastic. An axial wall 104 of the upper housing 102 is received by a recess, indent or groove 105 of the lower housing 103, and extends in an axial direction of an axis AB (referred to hereafter to as the axial direction) of a plane ABCD passing through the playback device 100. In FIG. 1, the playback device is in an upright orientation, with the axis AB aligned in a vertical direction, such that the plane ABCD is an upright plane.

The upper housing 102 and the lower housing 103 form an upper surface 106 and a lower surface 108, respectively, of an acoustic waveguide 112. When the playback device 100 is in the upright orientation, the upper surface 106 bounds the waveguide 112 from above, and the lower surface 108 bounds the waveguide 112 from below. The upper surface 106 has an aperture 110 for receiving an electroacoustic transducer 114, also referred to as a speaker driver. The transducer 114 is disposed within the aperture 110, and includes a dome or a cupola 116 in fluid communication with the waveguide 112. In this embodiment, the transducer 114 is disposed on the axis AB. A portion of the upper surface 106 of the waveguide 112 surrounds the transducer 114, and at least partially axially overlaps the transducer 114 with respect to the axis AB. The lower surface 108 of the waveguide 112 extends from the axial wall 104 and includes a recess 118 configured to receive the cupola 116. The recess 118 is arranged to substantially conform to the shape of the cupola 116, such that when the transducer 114 is disposed within the aperture 110, the recess surrounds part of the cupola 116. The upper surface 106 and the lower surface 108 extend toward an opening 120 of the waveguide 112.

The transducer 114 is disposed above the lower surface 108 of the waveguide 112, and is arranged such that a convex surface of the cupola 116 faces substantially downward when the playback device is in an upright orientation.

The cupola 116 is arranged to be displaced in the axial direction in response to an alternating electric signal received by the transducer 114, thereby generating acoustic waves. In this embodiment, the transducer 114 is a tweeter, and the transducer 114 produces acoustic waves having a relatively high frequency, for example between about 2 kHz and about 20 kHz. The opening 120 of the waveguide 112 has a dimension in the axial direction that is relatively small compared with the wavelengths of acoustic waves generated by the transducer 114. Waves generated by the transducer typically have wavelengths, for example, between about 2 centimeters (cm) and 20 cm. The dimension of the opening 120 in the axial direction in this embodiment is less than 1 cm, resulting in a relatively wide angular dispersion in planes coplanar with the axis AB.

The lower surface 108 of the waveguide 112 delimits a first opening 122 of a first drainage channel 124. The first drainage channel 124 extends from the first opening 122 and is arranged to direct liquid from inside the waveguide 112 toward the drainage outlet 126. In the present embodiment, the first drainage channel 124 has a circular cross section in a plane perpendicular to the axis AB. In other examples, the first drainage channel 124 may have a non-circular cross-section, for example a square cross-section or an irregular cross section. The first drainage channel 124 extends in an axial direction of the axis AB, such that when the playback device is in the upright orientation, the first drainage channel 124 is arranged to direct liquid away from the lower surface 108 of the waveguide 112 and toward the drainage outlet 126. Thus, if water or another liquid enters the waveguide 112 when the playback device is in the upright orientation, the water or other liquid will not collect on the cupola 116. Detrimental effects caused by the liquid, or by residues left by the liquid, collecting on the cupola 116 are thereby reduced.

The cross-sectional area of the drainage channel 124 in planes perpendicular to the axis AB slightly decrease with distance from the opening 122, and therefore the drainage channel 124 has the shape of a frustum with a small non-zero draft angle between a curved surface of the frustum and an axis of the frustum. For example, the draft angle may be about 1.5 degrees. Providing a non-zero draft angle, such that the cross-sectional area of the drainage channel 124 decreases with distance from the opening 122, assists in the manufacture of the lower housing 103. A non-zero draft angle may facilitate the removal of a mold when the portion of the lower housing 103 forming the drainage channel 124 is manufactured by a molding process. In other examples, a draft angle of zero may be used such that a drainage channel is shaped as a prism, for example a cylinder.

The opening 122 of the drainage channel 124 has a minimum dimension of at least 0.5 mm. In the present embodiment, the opening 122 is circular and has a diameter of about 1.1 mm. An opening having a minimum dimension of at least 0.5 mm allows water, and other liquids having similar viscosities to water, to pass through the opening under the influence of gravity without being impeded by the effects of surface tension. For openings having a minimum dimension of less than about 0.5 mm, the effects of surface tension may prevent water or other liquids from passing through the opening and into a drainage channel.

The opening 122 of the drainage channel 124 has a maximum dimension of less than 5 mm, for example less than 2 mm or less than 1.5 mm. As mentioned above, the opening 122 is circular and has a diameter of about 1.1 mm. The maximum dimension of the opening 122 is significantly smaller than the wavelength of most of the acoustic waves generated by the transducer 114, and the effect of the opening 122 on the pressure field inside the waveguide 112 has little noticeable effect on the acoustic output of the playback device 100. Openings having a maximum dimension of greater than 5 mm may have a more significant effect on the pressure field inside a waveguide, and may therefore have a detrimental effect on the acoustic output of a playback device.

A drain floor portion 128 defines a lower surface of an interior channel 130. The interior channel 130 is in fluid communication with the first drainage channel 124. The drain floor portion 128 is sloped to direct liquid from the drainage channel 124 toward the drainage outlet 126 when the playback device 100 is in the upright orientation. The drainage outlet 126 is delimited by an outer wall of the lower housing 103, such that liquid is directed along the interior channel 130, out of the drainage outlet 126, and is deposited outside the playback device 100.

The recess 118 comprises a first local extremum of the lower surface 108 of the waveguide 112. When the playback device is in the upright orientation, the recess 118 comprises a first local minimum height of the lower surface 108. The first opening 122 of the first drainage channel 124 is located at the first local extremum of the lower surface 108, such that when the playback device is in the upright orientation, liquid inside the waveguide 112 is directed at least partially toward the first opening 122. For example, liquid that flows into the recess 118 can be directed toward the first opening 122.

The minimum distance between the cupola 116 and the lower surface 108 is less than 5 mm. A waveguide having a small transverse dimension compared with the wavelength of acoustic waves propagating in the waveguide is unlikely to give rise to undesired acoustic effects caused by pressure variations in the transverse direction, for example undesired effects caused by an excitation of high-order waveguide modes. It is desirable for the distance between the cupola 116 and the lower surface 108 to be similar to the transverse dimension of the waveguide 112 for approximate impedance matching and efficient transfer of acoustic energy from the transducer 114 to the waveguide 112. Accordingly, the clearance between the cupola 116 and the recess 118 in the lower surface 108 is substantially the same as a transverse dimension of the waveguide 112 (e.g., within about 1%, within about 2%, within about 5%, within about 10%). In the present embodiment, the minimum distance between the cupola 116 and the lower surface 108 is about 2 mm.

Due to the small clearance between the cupola 116 and the lower surface 108, as well as the small transverse dimension of the waveguide 112, a relatively small volume of liquid inside the waveguide 112 may have detrimental effects on the acoustic output of the playback device 100. Furthermore, a relatively small volume of liquid inside the waveguide 112 can fill the recess 118 and reach the cupola 116 or the transducer 114 disposed above the lower surface 108. If the liquid remains in contact with the cupola 116 or transducer 114 for a significant amount of time, for example, several minutes, several hours, or several days, the liquid may corrode or otherwise damage the cupola 116 or the transducer 114. The playback device 100 is designed to have a long useable lifespan, for example a lifespan of at least 10 years, and therefore there is a need to mitigate the effects of corrosion or damage, which may otherwise accumulate over a long period of time. Surfaces of the transducer 114 that are in fluid communication with the waveguide 112, including the surface of the cupola 116, are treated with a hydrophobic coating to minimize the effects of corrosion or other damage caused by water. Any suitable hydrophobic coating may be used, for example hydrophobic polyurethane. There is still, however, a need for liquid inside the waveguide 112 to be drained efficiently.

The lower surface 108 of the waveguide 112 has a generally undulating shape, as will be described in more detail hereafter, and comprises a second local extremum. When the playback device 100 is in the upright orientation, the second local extremum is a local minimum. The lower surface 108 of the waveguide 112 delimits a second opening 132 of a second drainage channel 134, the second opening 132 being located at the second local extremum, such that when the playback device 100 is in the upright orientation, liquid inside the waveguide 112 in the vicinity of the second opening 132 is directed at least partially toward the second opening 132.

The second drainage channel 134 extends from the second opening 132 and is arranged to direct liquid from inside the waveguide 112 toward the drainage outlet 126. The first drainage channel 124 and the second drainage channel 134 are thus each arranged to direct liquid from inside the waveguide 112 toward the same drainage outlet 126. In other examples of the disclosed technology, more than two drainage channels are arranged to direct liquid from inside a waveguide toward a same drainage outlet. In other examples, two or more drainage channels are arranged to direct liquid from inside a waveguide toward different drainage outlets.

In some examples of the disclosed technology, a bounding surface of a waveguide delimits openings of two or more drainage channels. In some examples, a bounding surface of a waveguide bounds the waveguide from below and has an undulating shape comprising several local extrema, for example two, three, or four local extrema, and an opening of a respective drainage channel is located at each of the local extrema, such that the bounding surface is arranged to direct liquid at least partially toward the openings and the respective drainage channels are arranged to direct liquid from inside the waveguide toward a drainage outlet.

Figure 2:
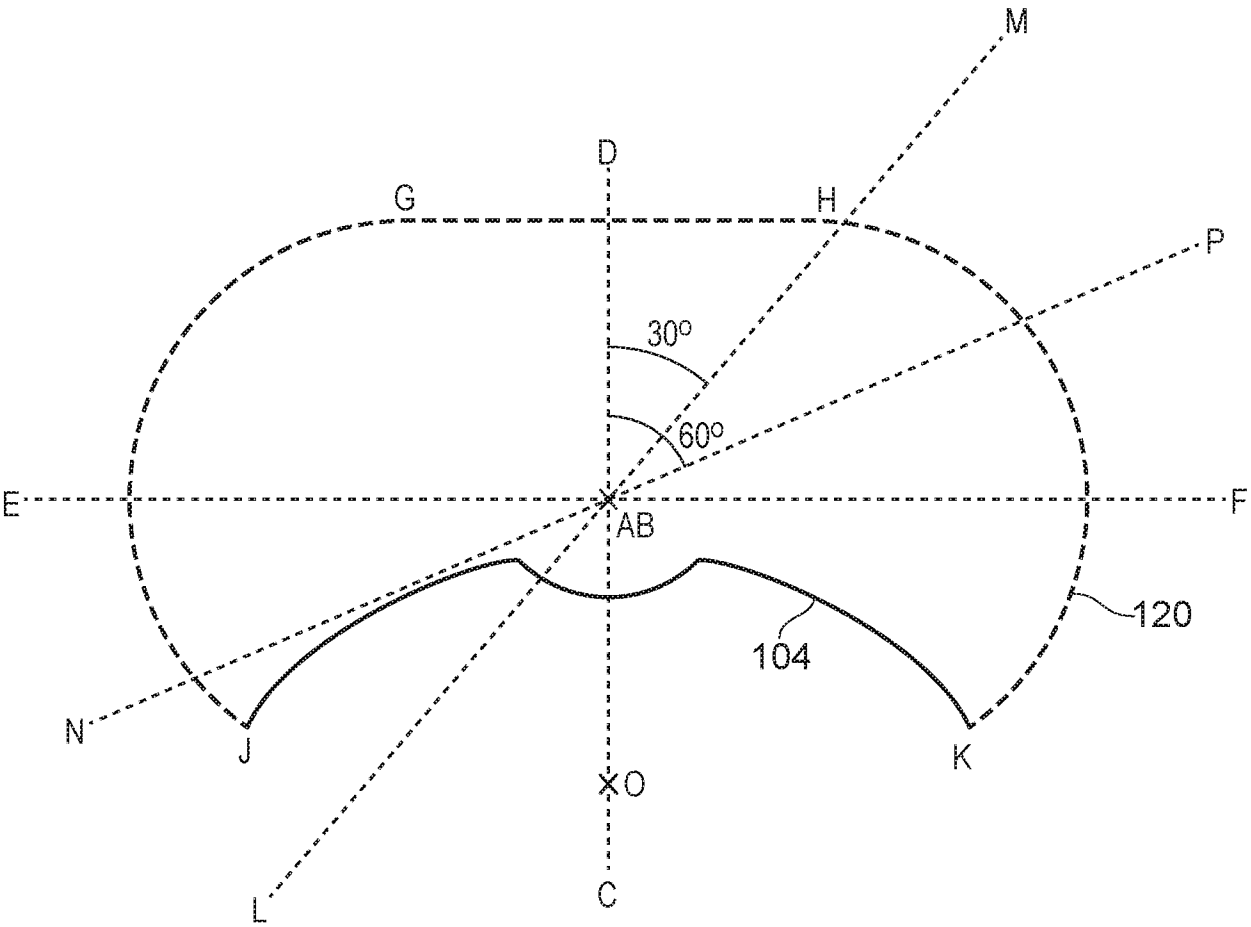
FIG. 2 is a cross-sectional plan view of the playback device of FIG. 1 in a plane perpendicular to the axial plane of FIG. 1.

FIG. 2 is a cross-sectional plan view of the playback device of FIG. 1 in a plane perpendicular to the axial plane of FIG. 1. FIG. 2 shows a projection of the opening 120 of the waveguide 112 onto a plane CDEF perpendicular to the plane ABCD. In the illustrated embodiment, the opening 120 extends around the axis AB, and subtends an angle of between 180 degrees and 360 degrees from the axis AB. In other examples, the opening 120 subtends an angle of less than 180 degrees. Experiments have shown that angular dispersions of between 180 degrees and 240 degrees are suitable for outdoor usage, whilst also reducing undesirable acoustic effects caused by back reflection in situations where the playback device 100 is placed adjacent a wall. In other examples, however, an opening of a waveguide subtends a suitable angle less than 180 degrees (e.g., 90 degrees, 135 degrees, 170 degrees).

The projection of the opening 120 onto the plane CDEF follows an arc of a stadium having a straight portion GH and two circular arc portions GJ and HK. In other examples, openings may follow other paths, for example an elliptical arc, an oval arc, or an irregular arc. In some examples, an opening may follow a complete path around an axis. The axial wall 104 comprises a concave portion and two convex portions. The concave portion has a projection onto the plane CDEF of a circular arc centered at the axis AB. The two convex portions have projections onto the plane CDEF of circular arcs centered at a point O outside the playback device 100, the projections passing between the point O and the axis AB. The convex portions leave space for a carrying handle at a rear side of the playback device 100, for example. In this embodiment, the axial wall 104 subtends an angle of 102 degrees from the axis AB.

The playback device 100 may be oriented in a tilted resting orientation such that the axis AB is not vertically-aligned. For example, the playback device 100 may rest in a tilted resting orientation on a substantially horizontal surface such that the axis AB is substantially horizontal. For example, the playback device 100 may rest in a tilted resting orientation such that the axis CD is substantially vertical with C above D, or with D above C. Alternatively, the playback device 100 may rest in a tilted resting position such that the axis AB is neither vertical nor horizontal. The waveguide 112 is arranged to direct liquid from inside the waveguide 112 toward the opening 120 when the playback device is in a tilted resting orientation. As mentioned above, in the illustrated embodiment the opening 120 subtends an angle of greater than 180 degrees. Furthermore, a portion of the waveguide 112 extending toward the opening 120 is perpendicular to the axis AB. Therefore, when the playback device 100 is in a tilted resting orientation with the axis AB substantially horizontal, a portion of the waveguide extends downward toward the opening 120, and liquid inside the waveguide is directed at least partially toward the opening 120. Due to the large angle subtended by the opening 120, as well as the relatively small angle subtended by the axial wall 104, in the present embodiment liquid inside the waveguide is directed at least partially toward the opening 120 for any tilted resting orientation in which the axis AB is substantially horizontal.

Figure 3A:
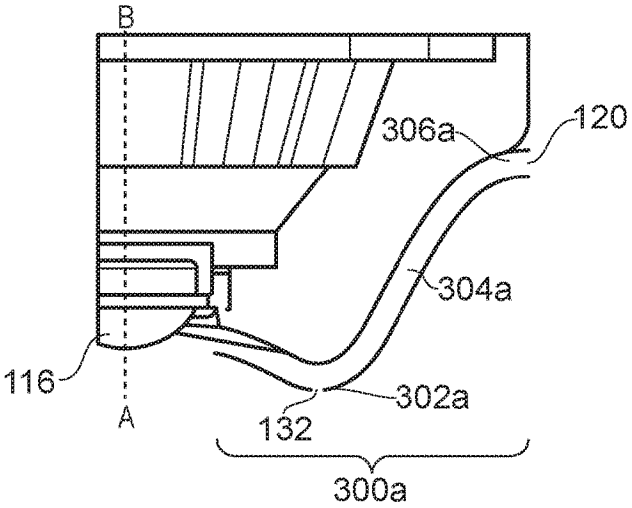
FIG. 3A is a first cross-sectional side view of a waveguide portion along corresponding angle around the axis of the playback device of FIG. 1.

FIGS. 3A-3D are cross-sectional side views of a waveguide portion along corresponding angles around the axis of the playback device of FIG. 1. The cross-section in the plane ABCD, as shown in FIG. 3A, follows a path having a first substantially S-shaped, serpentine section 300*a* comprising a first local minimum 302*a*, a first point of inflection 304*a*, and a first radial portion 306*a*, the first radial portion 306*a* extending toward the opening 120. The plane ABCD is coplanar with the second local extremum of the lower surface 108 of the waveguide 112, and accordingly the first local minimum 302*a* corresponds to the second local extremum of the lower surface 108.

The first radial portion 306*a* is perpendicular to the axis AB, which results in a maximum intensity of acoustic waves being emitted in a direction perpendicular to the axis AB. It is envisaged that, during operation, the playback device 100 will often be in the upright orientation, and with the opening 120 at a similar elevation to the ears of listeners. It is therefore desirable for a maximum intensity of acoustic waves to be emitted in a direction perpendicular the axis AB.

When playback device 100 is in a tilted resting orientation with the axis AB substantially horizontally aligned, with D below C, the first radial portion 306*a* directs liquid from inside the waveguide 112 toward the opening 120. However, when the playback device 100 is in the upright orientation, the first radial portion 306*a* is substantially horizontal. The portion of the lower surface 108 extending toward the opening 120 is also substantially horizontal, such that liquids may enter the waveguide 112 through the opening 120, for example due to splashing or precipitation, and be directed into the waveguide 112.

Figure 3B:
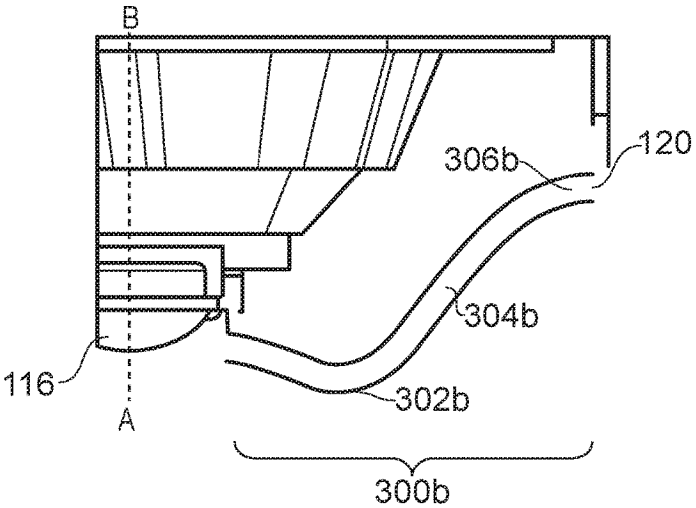
FIG. 3B is a second cross-sectional side view of a waveguide portion along corresponding angle around the axis of the playback device of FIG. 1.

The cross-section in the plane ABLM (which has an angle of 30 degrees to the plane ABCD, as shown in FIG. 2), is shown in FIG. 3B and follows a path having a second substantially S-shaped, serpentine section 300*b* comprising a second local minimum 302*b*, a second point of inflection 304*b*, and a second radial portion 306*b*. The second radial portion 306*b* extends toward the opening 120 and is perpendicular to the axis AB. The radial distance from the axis AB to the opening 120 in the ABLM cross-section is greater than the radial distance from the axis AB to the opening 120 in the ABCD cross-section, and accordingly the radial extent of the second S-shaped section 300*b* is greater than the radial extent of the first S-shaped section 300*a*.

The axial depth of the second local minimum 302*b* is less than the axial depth of the first local minimum 302*a*, and the axial separation of the two ends of the second substantially S-shaped section 300*b* is less than the axial separation of the two ends of the first substantially S-shaped section 300*a*. Furthermore, portions of the second substantially S-shaped section 300*b* are less curved than corresponding portions of the first substantially S-shaped section 300*a*. Due to the fact that the axial depth of the second local minimum 302*b* is less than the axial depth of the first local minimum 302*a*, water or other liquids inside the portion of the waveguide illustrated in FIG. 3B are directed toward the first local minimum 302*a*, corresponding to the local extremum of the lower surface 108, and therefore are directed at least partially toward the second opening 132.

Figure 3C:
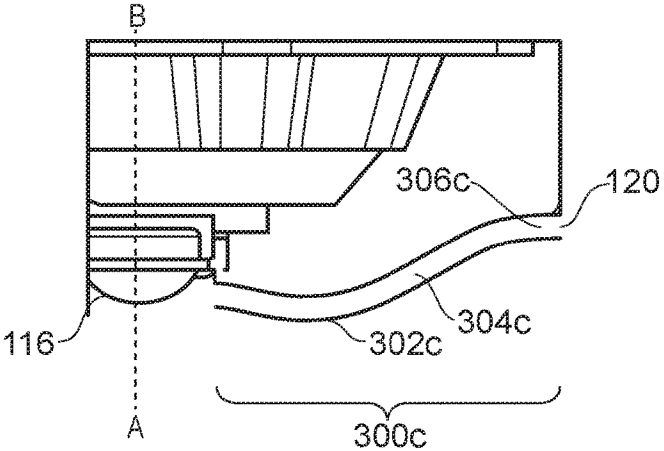
FIG. 3C is a third cross-sectional side view of a waveguide portion along corresponding angle around the axis of the playback device of FIG. 1.

The cross-section in the plane ABNP (which has an angle of 60 degrees with respect to the plane ABCD, as shown in FIG. 2), is shown in FIG. 3C and follows a path having a third substantially S-shaped, serpentine section 300*c* comprising a third local minimum 302*c*, a third point of inflection 304*c*, and a third radial portion 306*c*. The third radial portion 306*c* extends toward the opening 120 and is perpendicular to the axis AB. The radial distance from the axis AB to the opening 120 in the ABNP cross-section is greater than the radial distance from the axis AB to the opening 120 in the ABLM cross-section, and accordingly the radial extent of the third S-shaped section 300*c* is greater than the radial extent of the second S-shaped section 300*b*.

The axial depth of the third local minimum 302*c* is less than the axial depth of the second local minimum 302*b*, and the axial separation between the two ends of the third substantially S-shaped section 300*c* is greater than the axial separation of the two ends of the second substantially S-shaped section 300*b*. Furthermore, portions of the third substantially S-shaped section 300*b* are less curved than corresponding portions of the second substantially S-shaped section 300*a*. Due to the fact that the axial depth of the third local minimum 302*c* is less than the axial depth of the first local minimum 302*a*, water or other liquids inside the portion of the waveguide illustrated in FIG. 3C are directed toward the first local minimum 302*a*, corresponding to the local extremum of the lower surface 108, and therefore are directed at least partially toward the second opening 132.

Figure 3D:
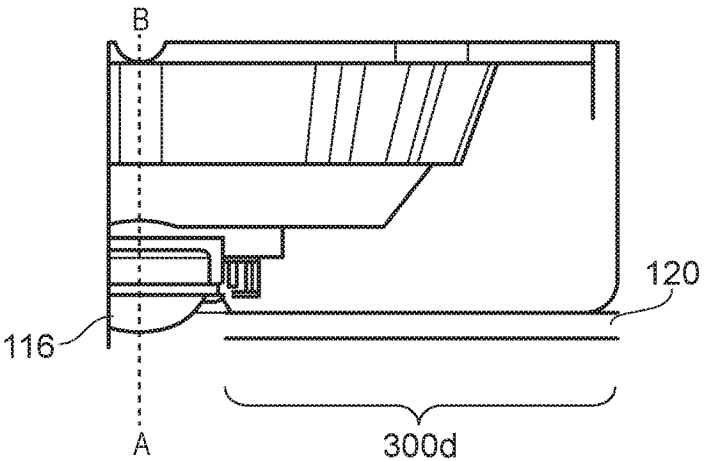
FIG. 3D is a fourth cross-sectional side view of a waveguide portion along corresponding angle around the axis of the playback device of FIG. 1.

The cross-section of the waveguide 100 in the plane ABEF, as shown in FIG. 3D, follows a path having a straight section 300*d*. The substantially straight section 300*d* extends toward the opening 120 and is perpendicular to the axis AB. The radial distance from the axis AB to the opening 120 in the ABEF cross-section is greater than the radial distance from the axis AB to the opening 120 in FIG. 3C, and accordingly the radial extent of the straight section 300*d* is greater than the radial extent of the third S-shaped section 300*c*.

Water or other liquids inside the portion of the waveguide illustrated in FIG. 3D are directed toward the first local extremum or the second local extremum of the lower surface 108, and therefore are directed at least partially toward the first opening 122 and the second opening 132.

Although the radial distance from the axis AB to the opening 120 is different in each of the cross-sections of FIGS. 3A-3D, the varying curvature and axial variation of the waveguide, as described above, result in an acoustic path length within the waveguide 112, between the transducer 114 and the opening 120, that is substantially the same (e.g., within about 1%, within about 2%, within about 5%, within about 10%) for each of the cross-sections. Moreover, an acoustic path length within the waveguide 112, between the transducer 114 and the opening 120, is substantially constant and independent of azimuthal angle about the axis AB. In this embodiment, the acoustic path length is constant between the center portion of the transducer 114, through which the axis AB passes, and the opening 120.

Providing an equal acoustic path length from the transducer 114 to the opening 120 can result in waves generated by the transducer 114 that reach the opening 120 with a phase that is substantially constant and independent of azimuthal angle about the axis. Acoustic wave fronts propagating from the opening 120 can therefore spread out more evenly than conventional waveguides with varying path-lengths, resulting in substantially uniform directivity in which listeners positioned at different locations around the playback device 100 will have similar listening experiences. By contrast, if the acoustic path length within the waveguide was not substantially constant, wave fronts would propagate from the opening 120 at frequency-dependent angles, potentially resulting in non-uniform, frequency-dependent directivity. In particular, frequency-dependent directivity may result in frequency-dependent regions of destructive and constructive interference, such that listeners at different locations may have different listening experiences, even if the listeners are positioned at substantially the same distance away from the playback device 100.

In order to provide a substantially constant acoustic path length from the transducer 114 to the opening 120, the lower surface 108 of the waveguide 120 has an undulating shape.

In particular, the variation in radial distance between the axis AB and the opening 120 is compensated by introducing axial variations within the waveguide 112, as described above. In the present embodiment, the undulating shape comprises two local extrema, the first local extremum located within the recess 118 for receiving the cupola 116 of the transducer 114, and the second local extremum resulting from providing a path length inside the waveguide 112 that is constant and independent of azimuthal angle about the axis AB. In other examples, an opening of a waveguide may have a different projection onto a plane perpendicular to an axis, and compensating for a variation in radial distance from the axis to the opening may result in a bounding surface of the waveguide comprising a different number of local extrema, for example one, two, three, or four local extrema.

Figure 4:
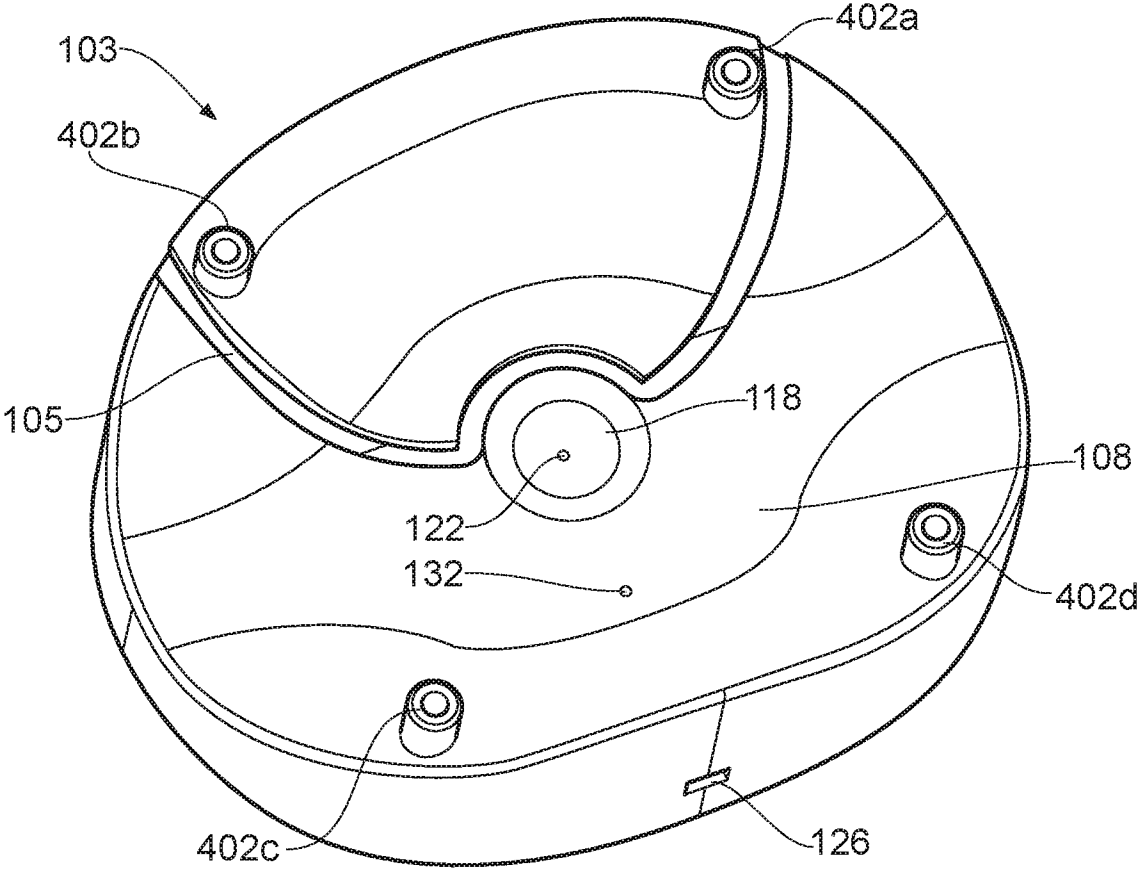
FIG. 4 is top view of a portion of the playback device of FIG. 1.

FIG. 4 is top view of a portion of the playback device 100 of FIG. 1. FIG. 4 shows a portion of the lower housing 103 of the playback device 100, including the indent 105 for receiving the axial wall 104 of the upper housing 102. As described above, a portion of the lower housing 103 forms the lower surface 108 of the waveguide 112, which contains the recess 118 for receiving the cupola 116 of the transducer 114. As described above, the lower surface 108 comprises two local extrema. The first opening 122 of the first drainage channel 124 is located at the first local extremum, and the second opening 132 of the second drainage channel 134 is located at the second local extremum. When the playback device 100 is in the upright orientation, the lower surface 108 is arranged to direct liquid at least partially toward the first opening 122 and the second opening 132. FIG. 4 further shows four axial pillars 402*a*, 402*b*, 402*c*, and 402*d*, collectively referred to as axial pillars 402, disposed within the waveguide 112. The axial pillars 402 support the upper housing 102, and each of the axial pillars 402 is threaded to receive a screw in order to secure the upper housing 102 to the lower housing 103. The axial pillars 402 completely enclose the screws when the upper housing 102 is secured to the lower housing 103, such that the screws are not exposed to water or other liquid inside the waveguide 112. Other methods of fastening such as bonding, snap-fit, and/or friction-fit may also be used in other examples.

Figure 5:
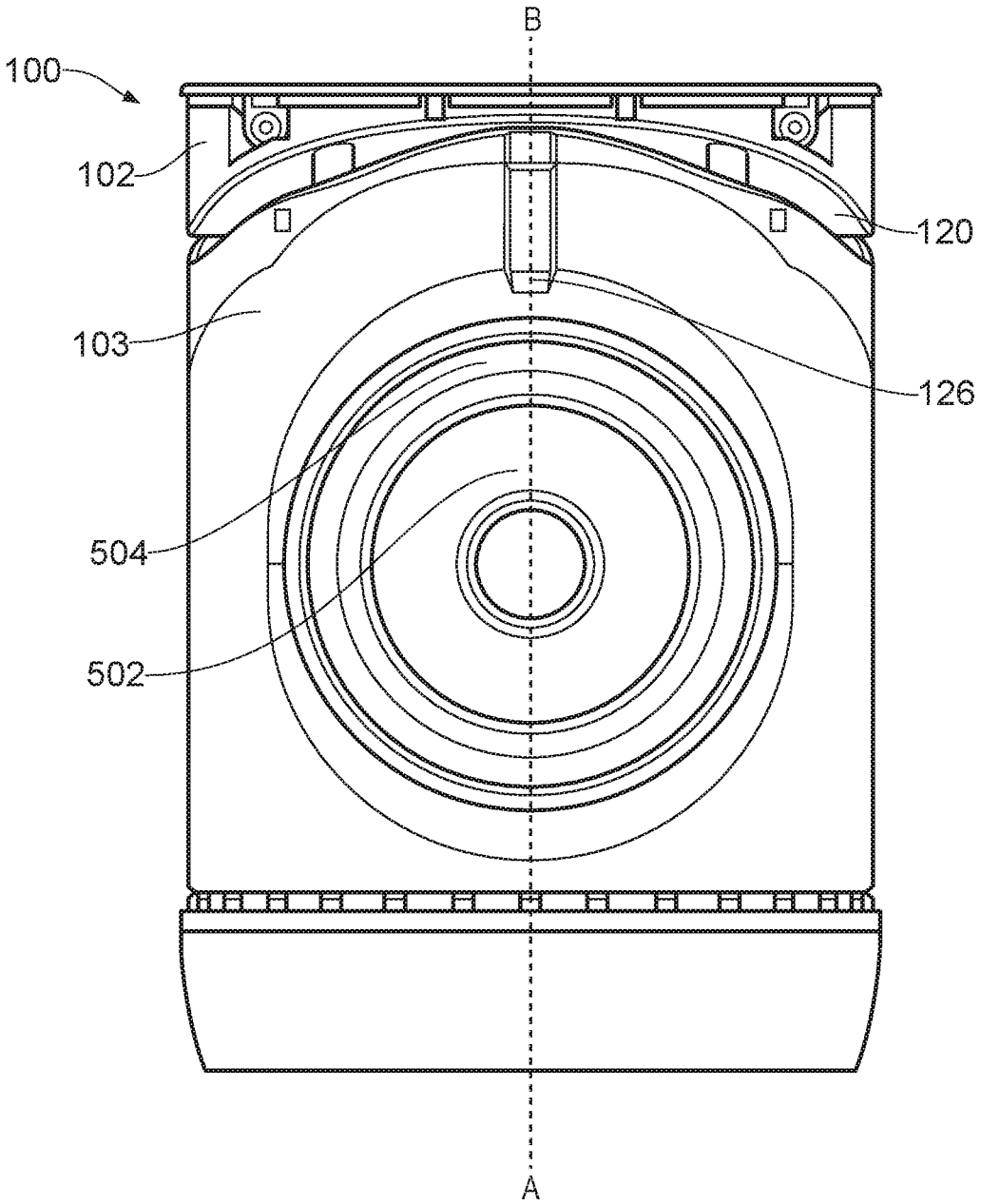
FIG. 5 is a front view of the playback device of FIG. 1.

As shown in FIG. 5, the playback device 100 includes a woofer, which is an electroacoustic transducer or speaker driver operable to generate low- to mid-frequency acoustic waves (for example, acoustic waves having a frequency of between about 40 Hz and about 2 kHz). The woofer includes a diaphragm or cone 502 coaxially surrounded by a seal 504. It is desirable to limit the axial separation between the opening of the waveguide 120 and the cone 502 of the woofer, thereby limiting a separation of apparent sources of acoustic waves of different frequencies, which may otherwise give rise to an undesirable experience for listeners. For example, it is desirable to limit the maximum axial separation between the opening 120 and the center of the cone 502 to less than about 20 cm, less than about 15 cm, or less than about 12 cm. The desired limitation of the axial separation between the cone 502 and the opening 120 limits the axial variation of the opening 120. The second local extremum of the lower surface 108 results in sufficient axial variation of the waveguide 112 to compensate for the variation in radial distance between the axis AB and the opening 120, even though the axial variation of the opening 120 is limited. In other examples, suitable means for compensating for a varying radial distance depend on the geometry and features of the playback device, for example whether the playback device includes a low-frequency electroacoustic transducer such as a woofer.

The playback device 100 contains a sealed acoustic volume behind the cone 502. When the woofer is in operation, the sealed acoustic volume has the effect of damping oscillations of the cone 502, reducing reverberation of the cone 502 and giving rise to a more precise response to low-frequency signals and further giving rise to a shallow low-frequency roll-off curve. Sealed woofer systems, such as the woofer system of the playback device 100, are typically more compact than comparable open woofer systems, which is advantageous for portability of the playback device 100.

Water or other liquids are prevented from entering the sealed acoustic volume of the playback device 100. As shown in FIG. 5, the drainage outlet 126 is positioned above the cone 502, such that then the playback device 100 is in the upright orientation, water or another liquid directed from inside the waveguide 112 to the drainage outlet 126 is deposited outside the sealed acoustic volume.

Figure 6:
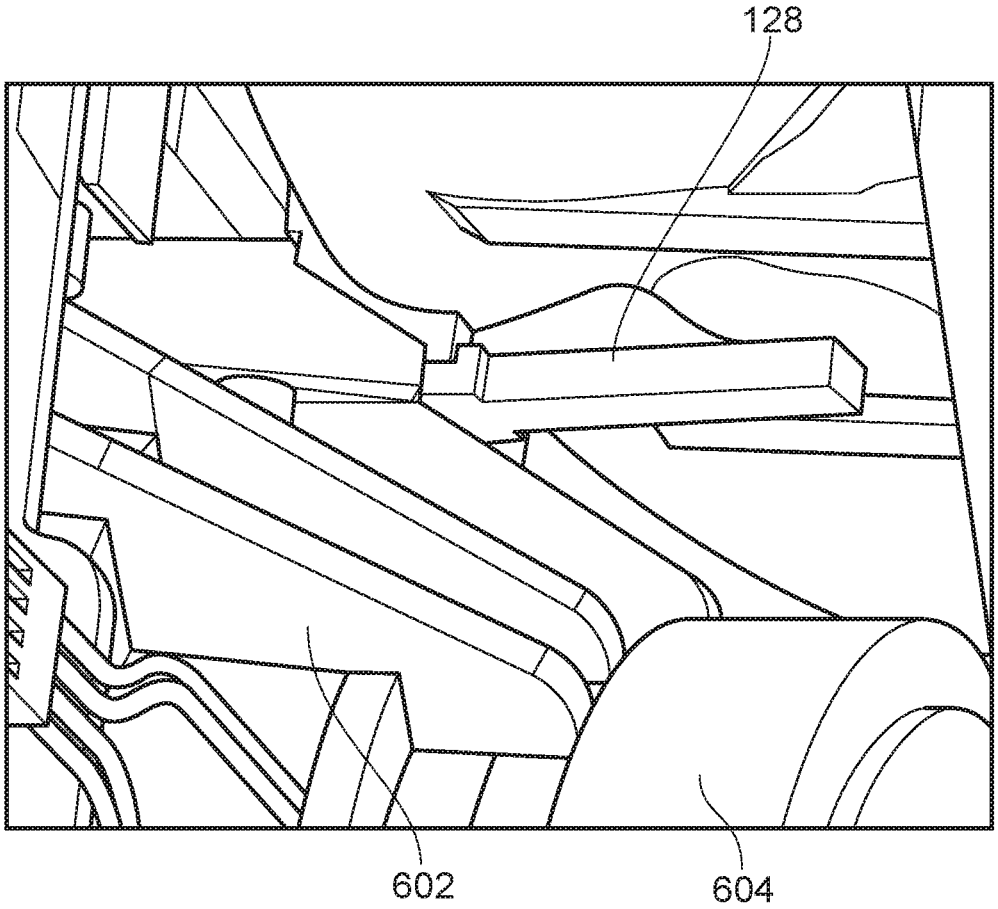
FIG. 6 is an interior view of a portion of the playback device of FIG. 1.

FIG. 6 shows an interior view of the sealed acoustic volume of the playback device 100. As shown, a woofer basket or woofer frame 602 supports a woofer magnet 604 inside the sealed acoustic volume. The drain floor portion 128, which defines the lower surface of the interior channel 130, passes through the sealed acoustic volume and is sloped to direct water or another liquid from inside the waveguide 112, through the sealed acoustic volume, toward the drainage outlet 126. Arranging the interior channel 130 to pass at least partially through the sealed acoustic volume has no significant effect on the acoustic output of the woofer, and makes efficient use of space, which is advantageous for portability of the playback device 100. Furthermore, arranging the interior channel 130 to pass at least partially through the sealed acoustic volume allows the axial separation between the cone 502 of the woofer and the opening 120 of the waveguide 112 to be limited conveniently.

Figure 7:
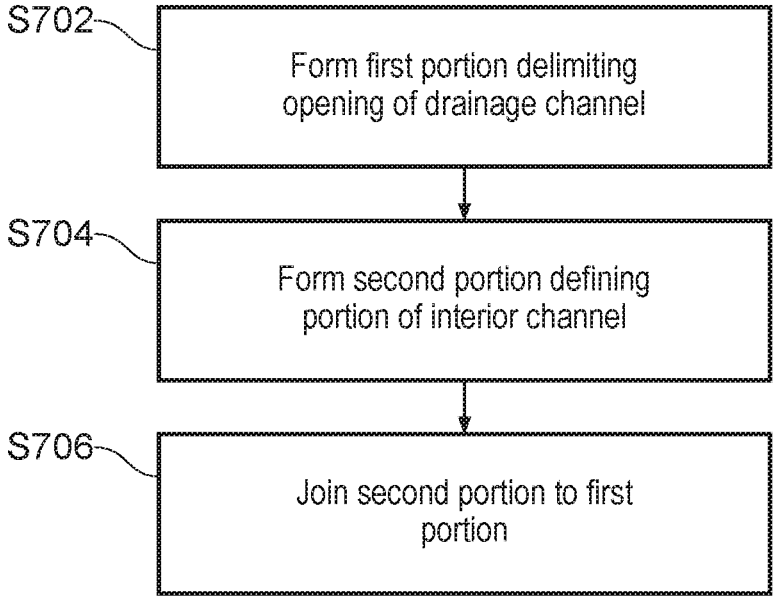
FIG. 7 is a flow diagram representing an exemplary method of manufacturing the playback device of FIG. 1.

The drain floor portion 128 is formed separately from the lower housing 103. As shown in FIG. 7, an exemplary method of manufacturing the playback device 100 comprises forming, at 5702, the lower housing 103 defining the lower surface 108 of the waveguide 112, the lower surface 108 delimiting the first opening 122 of the first drainage channel 124 and the second opening 132 of the second drainage channel 134. The method further comprises forming, at 5704, the drain floor portion 128 defining the lower surface of the interior channel 130. Forming the lower housing 103 and the drain floor portion 128 includes molding the lower housing 103 and the drain floor portion 128. In other examples, manufacturing the playback device 100 may include 3D printing at least one of the lower housing 103 or the drain floor portion 128.

The exemplary method comprises joining, at 5706, the drain floor portion 128 to the lower housing 103, such that the drainage channel 124 is in fluid communication with the interior channel 130. In the present example, joining the drain floor portion 128 to the lower housing 103 comprises bonding the drain floor portion 128 to the lower housing 103, for example using an adhesive. Any suitable adhesive can be used, such as a contact adhesive, a hot melt adhesive or a permanent pressure-sensitive adhesive. In other examples, joining the drain floor portion 128 to the lower housing 103 comprises welding the drain floor portion 128 to the lower housing 103, such as hot welding or by ultrasonic welding.

Forming the lower housing 103 and the drain floor portion 128 separately and then joining the drain floor portion 128 to the lower housing 103 advantageously allows for the interior channel 130 to be formed using relatively simple molds. By contrast, forming the interior channel during the process of forming the lower housing 103 may require a complicated mold having additional moving portions.

Other embodiments may form the interior channel as a single piece, for example using an additive manufacturing method such as 3D printing.

The above embodiments are to be understood as illustrative examples of the invention. Further embodiments of the invention are envisaged. For example, playback devices may include waveguides of any suitable shape, and may include other openings into which water can enter, for example an opening for a port or other connector, or an opening to a channel in which a microphone is disposed. Multiple drainage channels may be provided in such cases. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. A playback device comprising:

an acoustic waveguide having a bounding surface, the bounding surface delimiting a plurality of openings;

one or more drainage outlets; and a drainage channel extending from each of the plurality of openings and arranged to direct liquid from inside the waveguide toward at least one of the one or more drainage outlets.

2. The playback device of claim 1, wherein a portion of the bounding surface of the waveguide extending to at least one of the plurality of openings of the waveguide is substantially horizontal when the playback device is in an upright orientation.

3. The playback device of claim 1, wherein:

the bounding surface comprises a local extremum; and at least one of the openings delimited by the bounding surface is located at the local extremum, such that, when the playback device is in an upright orientation, the bounding surface bounds the waveguide from below and is arranged to direct liquid at least partially toward the at least one opening.

4. The playback device of claim 3, wherein a section of the waveguide has a substantially serpentine cross-section in an upright plane coplanar with the local extremum.

5. The playback device of claim 1, wherein multiple drainage channels are arranged to direct liquid from inside the waveguide toward a same drainage outlet.

6. The playback device of claim 1, wherein:

the bounding surface comprises a plurality of local extrema; and one of the plurality of openings delimited by the bounding surface is located at each of the local extrema, such that, when the playback device is in an upright orientation, the bounding surface bounds the waveguide from below and is arranged to direct liquid at least partially toward the plurality of openings.

7. The playback device of claim 1, wherein the bounding surface is a lower bounding surface of the waveguide, and wherein the playback device comprises an electroacoustic transducer in fluid communication with the waveguide and disposed above the bounding surface.

8. The playback device of claim 7, wherein a minimum distance between the electroacoustic transducer and the lower bounding surface is less than 5 mm.

9. The playback device of claim 7, wherein the lower bounding surface comprises a local extremum located in a recess of the lower bounding surface, the recess being configured to surround a portion of the electroacoustic transducer, and wherein an opening delimited by the lower bounding surface is located at the local extremum.

10. The playback device of claim 7, wherein the electroacoustic transducer is a tweeter.

11. The playback device of claim 1, wherein at least one of the openings has a minimum dimension of at least 0.5 mm.

12. The playback device of claim 1, wherein at least one of the openings has a maximum dimension of less than 5 mm.

13. The playback device of claim 1, wherein the waveguide is arranged to direct liquid from inside the waveguide toward at least one of the openings of the waveguide when the playback device is in a tilted resting orientation.

14. The playback device of claim 1, wherein the playback device comprises an electroacoustic transducer in fluid communication with the waveguide and disposed above the bounding surface, and wherein a portion of the electroacoustic transducer is treated with a hydrophobic coating.

15. The playback device of claim 1, wherein at least one drainage channel is in fluid communication with an interior channel, the interior channel at least partially passing through a sealed acoustic volume within the playback device.

16. A method of manufacturing a playback device, comprising:

forming a first portion defining a lower bounding surface of a waveguide, the lower bounding surface delimiting a plurality of openings of a drainage channel extending from each of the plurality of openings and arranged to direct liquid from inside the waveguide toward at least one of a plurality of drainage outlets;

forming a second portion defining at least part of an interior channel; and joining the second portion to the first portion, such that the drainage channel is in fluid communication with the interior channel.

17. The method of claim 16, wherein the joining comprises bonding the first portion to the second portion.

18. The method of claim 16, wherein the joining comprises welding the first portion to the second portion.

19. A playback device comprising:

an electroacoustic transducer;

an acoustic waveguide in fluid communication with the electroacoustic transducer, a lower bounding surface of the acoustic waveguide having an undulating shape, the lower bounding surface delimiting a plurality of openings located at local minima of the undulating shape;

respective drainage channels extending from each of the plurality of openings;

wherein the respective drainage channels are arranged to direct liquid from inside the waveguide toward a drainage outlet.

* * * * *